United States Patent [19]

Ozawa

[11] Patent Number: 4,556,818

[45] Date of Patent: Dec. 3, 1985

[54] INSULATING CRYSTALS FOR COATING ON A METAL MESH OF A STORAGE TUBE

[75] Inventor: Lyuji Ozawa, Glencoe, Ill.

[73] Assignee: Matsushita Electric Industrial Co., Ltd., Osaka, Japan

[21] Appl. No.: 454,354

[22] Filed: Dec. 29, 1982

[30] Foreign Application Priority Data

Dec. 29, 1981 [JP] Japan ..... 56-212847

[51] Int. Cl.[4] ..... H01J 31/38

[52] U.S. Cl. ..... 313/395; 313/393; 313/392

[58] Field of Search ..... 313/395, 396, 393; 365/121; 315/13.11

[56] References Cited

U.S. PATENT DOCUMENTS 2,861,207 11/1958 Smith et al. ..... 313/395
3,982,191 9/1976 Takita et al. ..... 313/393

OTHER PUBLICATIONS

*Applied Physics Letter,* 43(11), Dec. 1, 1983, pp. 1073–1074, Ozawa.

*Journal of the Electrochemical Society,* vol. 129, No. 7, Jul. 1982, pp. 1535–1540, Ozawa, L., "An Experimental . . . Cathodoluminescence".

*Journal of the Electrochemical Society,* vol. 128, No. 1, Jan. 1981, pp. 140–145, Ozawa, L., "An Experimental . . . Activator Ions".

*Primary Examiner*—David K. Moore

*Attorney, Agent, or Firm*—Wenderoth, Lind & Ponack

[57] ABSTRACT

Insulating crystals are coated on a metal mesh of a storage tube and give rise to a hysteresis effect with respect to the passage of flood electrons through the metal mesh, the hysteresis effect being caused by the persistent polarization of the insulating crystals when an electric field has been applied and the depolarization of the crystals due to the irradiation of an electron beam having an energy which is large enough to penetrate through the negative field produced by the persistent polarization. The clean surface of the insulating crystals, which contains recombination centers of electrons and holes and the deep traps of electrons and holes, is an essential feature of the insulating crystals and are necessary for the hysteresis effect with respect to the passage of the flood electrons through the metal mesh.

8 Claims, 3 Drawing Figures

INSULATING CRYSTALS FOR COATING ON A METAL MESH OF A STORAGE TUBE

BACKGROUND OF THE INVENTION

This invention relates to insulating crystals which are coated on a metal mesh within a storage cathode ray picture tube in order to partially and/or totally control the amount of flood electrons passing through the metal mesh and reaching the phosphor screen, the control being effected by means of the persistent polarization and depolarization of the insulating crystals coated on the metal mesh.

In more detail, the present invention is related to a device which continuously and steadily displays instantaneous information on a phosphor screen for a long time period. The device includes a cathode ray picture tube which essentially contains: (a) a writing gun used to supply a sharply focused electron beam in order to write the instantaneous information on the insulating material coated on a metal mesh, said information being subsequently displayed on the phosphor screen; (b) flood guns which steadily supply an electron shower uniformly throughout on the insulating material on the metal mesh; (c) a metal mesh coated with an insulating material; (d) electrodes for collecting electrons repulsed from the insulating material on the metal mesh and for collecting secondary electrons which are emitted from the insulating material on the metal mesh and from the phosphor crystals; and (e) a phosphor screen which emits luminescence. In this tube, the incident electrons from the flood and/or writing guns, at first, pass through the metal mesh installed in front of the phosphor screen, and the incident electrons which are passed through the metal mesh penetrate into the phosphor crystals so as to make visible luminescence light from the phosphor screen. The pass of the flood electrons through the metal mesh, giving rise to the steady luminescence from the phosphor screen, is controlled by means of the properties of insulating crystals forming said insulating material and coated on the metal mesh utilizing the irradiation of a writing electron beam on the insulating crystals.

In a storage cathode-ray picture tube, the electrons from the flood guns (i.e. flood electrons) easily pass through the metal mesh, if there is no negative field on the metal mesh, and reach the phosphor screen, resulting in the luminescence thereof. Because the flood electrons are uniformly spread on the metal mesh (and therefore subsequently spread on the phosphor screen), the entire phosphor screen uniformly emits a steady luminescence, if there is no negative field on the metal mesh. However, the tube does not exhibit the storage of information if there is no negative field on the metal mesh.

In order to have the storage of information, it is absolutely necessary that the tube has a negative field over the entire area of the metal mesh (i.e. the ready mode), and the negative field is partially removed from those areas in which the writing electron beam has irradiated (i.e. the writing or storage mode). When the entire area of the metal mesh has a negative field, the flood electrons are repulsed by the negative field and are collected by the collecting electrodes; the flood electrons do not pass through the metal mesh, thereby resulting in no luminescence from the phosphor screen. When the partial areas of the metal mesh have no negative field, the flood electrons pass through those areas and those areas of the phosphor screen, corresponding to the areas on the metal mesh which have no negative field, emit the luminescence.

It has been believed that under irradiation of the flood electrons, the insulating crystals on the metal mesh are negatively charged due to the fact that the number of secondary electrons emitted from the crystals is less than the number of incident electrons entering the crystals; i.e. the ratio of the number of secondary electrons emitted to that of the incident electrons is less than one, e.g. $\delta<1$. Under the irradiation of the writing electron beam, the ratio is greater than one (e.g. $\delta>1$), resulting in positively charged crystals. The positively charged crystals on the metal mesh allow the flood electrons to pass through the metal mesh, and the passed flood electrons hit the phosphor crystal to produce luminescence. This concept leads to a conclusion that insulating crystals which have a high ratio of secondary electron emission may have an advantage when used as the crystals coated on the metal mesh in a storage tube. According to this conclusion, one is looking for insulating crystals which have a high ratio of secondary electron emission. However, there is no direct method to determine the ratio of secondary electron emission, and the ratio is traditionally estimated from the measurement results of the amount of the persistent charges on the surface of the insulators after irradiation by the electron beam. Using this technique, it has been determined that magnesium oxide (MgO) has the largest ratio. Thus, magnesium oxide has been coated on the metal mesh in storage tubes. However, the properties of magnesium oxide are very sensitive to the preparation conditions, and they are markedly changed from tube to tube. The reproducibility in the production of storage tubes is poor due to the poor reproducibility of the preparation of magnesium oxide, and a substitute insulator is desired.

SUMMARY OF THE INVENTION

The mechanisms for the generation of secondary electrons in a crystal by incident electrons has recently been theoretically and experimentally clarified. The results show that the emission ratio of the secondary electrons is always greater than one, even with incident electrons having a low energy; e.g. typical flood electrons with an energy level of 150 electron volts. The ratio of the secondary electron emission is never smaller than one; it is always greater than one. It is clear that the hypothesis which states that the ratio of the secondary electron emission for incident electrons having a low energy level is smaller than one is therefore incorrect. Storage tubes do not utilize the secondary emission ratio of the insulating crystals coated on a metal mesh.

It is found after a careful study of insulating crystals, that storage tubes utilize the peculiar properties of the insulating crystals. Some insulating crystals show a persistent polarization when an electric field has been applied across the crystals, and the persistent polarization is instantaneously depolarized when a writing electron beam has irradiated the persistently polarized crystals. The polarity, at the gun side, of the persistent polarization on the insulating crystals is in accordance with the polarity applied to the metal mesh; i.e. when a negative field has been applied to the metal mesh, the insulating crystals on the metal mesh have a persistent polarization with a negative polarity at the gun side. When a positive field has been applied to the metal mesh, a persistent polarization with a positive polarity at the gun side is obtained. Storage tubes utilize the persistent polarization and depolarization of the insulating crystals to control the passage of flood electrons through the metal mesh.

The present invention provides insulating crystals, which are coated on the metal mesh in storage tubes, and which give rise to good reproducibility in the production of storage tubes with a high writing speed and a high brightness of luminescence from the phosphor screen.

DETAILED DESCRIPTION OF THE INVENTION

Figure 1:
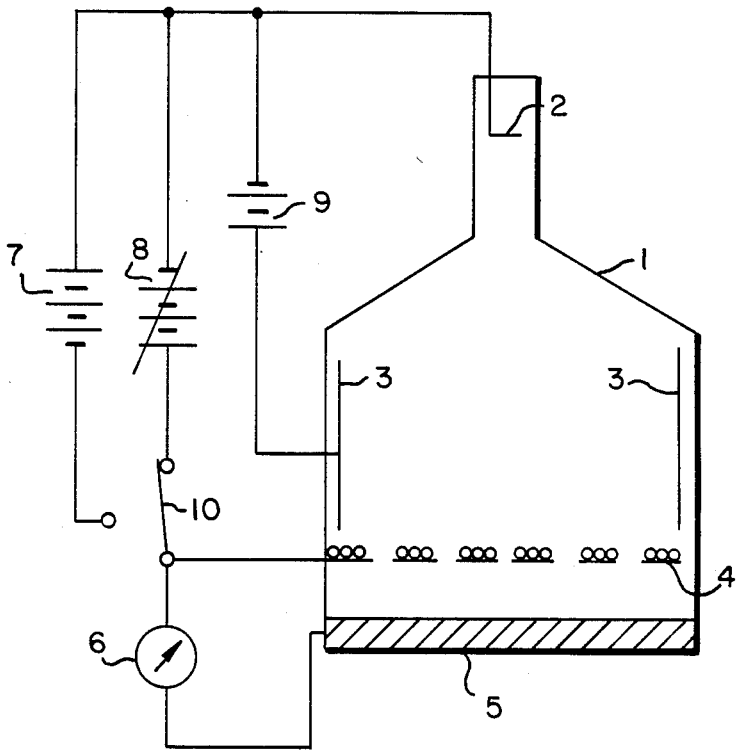
FIG. 1 is a schematic of the cathode-ray tube used to measure the passage of the electrons from the cathode through the metal mesh, by means of the properties of the insulating crystals coated on the metal mesh; wherein element 1 is a glass envelope; element 2 is a cathode; elements 3 are collecting electrodes; element 4 is a metal mesh coated with insulating crystals; element 5 is an electrode used to collect the electrons which are passed through the metal mesh; element 6 is a current meter; elements 7, 8 and 9 are power supplies and element 10 is a switch.

When a crystal is irradiated by incident electrons, a large part of the incident electrons penetrate into the crystal, and the residual electrons are ejected from the crystal due to the elastic scattering with the ions arranged in the surface layers of the crystals, (i.e. backscattered primary electrons). The penetrating electrons lose their energy by elastic and inelastic collisions with the lattice ions, with single and/or multiple scattering models, along the electron trajectories, generating x-rays, Auguer electrons, secondary electrons, electron-hole pairs, and phonons. The lattice ions are excited not only by the incident electrons but also by the secondary electrons generated internally. It is known that the secondary electrons generated internally and the scattered incident primary electrons form the electron gas plasma in the crystal, and the lattice ions are also excited with the electron-plasmon interaction to produce other secondary electrons of an energy level which is smaller than that of the aforementioned secondary electrons. The mean free path of the plasma electrons (i.e. the average distance which an electron travels in the crystal without a collision) depends on the energy of the plasma electrons, and may be theoretically calculated. In the conditions of the storage tube operation, the mean free path is about 10 Å, which is equivalent to three to five lattice distances, depending on the materials used. Hence, only the secondary electrons generated in the surface volume at a depth which is smaller than the mean-free path can escape from the crystal surface, giving rise to secondary electrons which can be collected in front of the crystal. These secondary electrons have an energy level which is smaller than 50 electron volts, and are called "true secondary electrons" as distinguished from the secondary electrons which cannot escape from the crystal and from the backscattered primary electrons. Each collision of the plasma electrons with the lattice ions produces one secondary electron. The probability that one penetrating electron collides with the lattices can be calculated by the Monte Carlo technique. The calculation shows that the incident electron, including the secondary electrons generated in the crystal, collides a few times with the lattice ions in a surface volume which is shallower than the mean free path, i.e. one entered electron may produce a few true secondary electrons. This means that the ratio ($\delta$) of the true secondary electrons to the entered electrons is always greater than one when the incident electron has penetrated into the crystal. The reported experimental $\delta$-values for a given insulator is nearly constant with respect to the accelerating voltage, supporting the model described above.

Thus, the hypothesis that the $\delta$-values of the true secondary electrons is smaller than one, in some voltage range, which has traditionally been believed, is incorrect. It follows that storage tubes actually do not utilize the ratio of the true secondary electrons from the insulating crystals. The ejection of the true secondary electrons and the subsequent phenomena which occur are undesirable for storage tubes, as stated below.

The ejection of the true secondary electrons from the crystal leaves holes in the surface volume of the crystal, and the number of holes left corresponds to the number of the true secondary electrons ejected. When the incident electrons have penetrated into the crystal, therefore, the crystal holds the positive charges (holes) in the surface volume on the irradiation side; as a result thereof, there are more electrons (i.e. true secondary electrons) ejected from the crystal than the number of entered electrons ($\delta > 1$). The positive field produced by the holes may extend outside the crystal (in a vacuum) and attracts the true secondary electrons and backscattered electrons. If the electrons have insufficient energy to re-enter into the crystal, then the electrons may be bound outside at a short distance from the crystal surface with an electrostatic force, and the bound electrons do not move from the surface of the crystal. These electrons which are fixed in front of the insulating crystal are called "surface-bound-electrons". The surface-bound-electrons instantly form in front of the crystals when the incident electrons have entered into the insulating crystal. If the crystals which have been irradiated are observed from the gun side, the crystals are apparently covered with negatively charged electrons (i.e. the surface-bound-electrons). If one merely pays attention to the surface-bound-electrons formed in front of the crystals, regardless of the binding force of the surface-bound-electrons, the surface-bound-electrons will be observed as an "electron cloud" formed in front of the crystals. In reality, the surface-bound-electrons always need the binding pairs that are the holes in the surface volume of the crystals, and they are tightly bound to each other against the crystal surface (i.e. the boundary of the crystal and the vacuum.).

If a powder of any insulating crystals (e.g. silica) is coated on the metal mesh of a storage tube, the surface-bound-electrons are instantaneously formed in front of the surface of the silica on the irradiation side after the flood electrons have entered. Because the powder silica is uniformly coated on the metal mesh, the negative field produced by the surface-bound-electrons on the silica may extend over the metal mesh on the gun side and effectively shields the metal mesh on the gun side so as to prevent the flood electrons from approaching the metal mesh. Thus, the lately arriving flood electrons are repulsed by the negative field formed in front of the metal mesh, and they cannot pass through the metal mesh. The repulsed electrons are collected by the collecting electrodes. Consequently, no luminescence is observed on the phosphor screen.

The repulsion of the flood electrons from the metal mesh coated with insulating crystals is a well known phenomena, and this has been attributed for a long time to the charging of the crystals due to the smaller ratio of the true secondary electron emission. As already described above, this statement is incorrect; the crystal itself is never negatively charged under the irradiation of either the flood electrons or the writing electron beam. It is the surface-bound-electrons, i.e. the apparent electron cloud, which is formed in front of the crystals which causes the repulsion of the flood electrons.

To observe the luminescence from the phosphor screen caused by the irradiation of the flood electrons, the surface-bound-electrons, which prevent the passage of the flood electrons through the metal mesh, must be removed from the surface of the insulating crystals. One possible way to remove the surface-bound-electrons from the surface of the insulating crystals is to apply a positive field over the crystals. Since the surface-bound-electrons are very tightly bound in front of the crystals, the application of a positive field produced by the collecting electrodes is not large enough to remove the surface-bound-electrons. The application of a positive field which is greater than the persistent polarization results in the change in the polarity of the persistent polarization of the insulating crystals, i.e. the positive polarity on the gun side allows the passage of the flood electrons through the entire metal mesh. Consequently, the entire area of the phosphor screen emits a luminescence. This is not practical. Another possible way is the irradiation of an electron beam having an energy which is large enough to penetrate through the negative field produced by the surface-bound-electrons.

The writing electron beam has an energy large enough to penetrate through the negative shield, and penetrates into the insulating crystals. However, the surface-bound-electrons formed on common insulators, like silica ($SiO_2$) or alumina ($Al_2O_3$) are not removed from the surface of the insulating crystals even if the writing electron beam is irradiated on the crystals. Besides this, more surface-bound-electrons are formed in front of the crystals by the irradiation of the writing electron beam. If common insulator materials (e.g. $SiO_2$) are coated on the metal mesh of the storage tube, the flood electrons never pass through the metal mesh even though the writing electron beam is irradiated on the common insulators on the metal mesh. This means that if the common insulators are coated on the metal mesh in a storage tube, the tube never effects the storage of information on the phosphor screen. In order to effect the storage of information on the phosphor screen, the metal mesh in a storage tube should be coated with proper insulating crystals in which the binding force of the surface-bound-electrons is weakened when the writing electron beam has penetrated into the insulating crystals. The surface-bound-electrons, in which the binding force has been weakened, can be removed from the surface of the crystals by the assistance of the electric field produced by the collecting electrodes.

This can be achieved if the holes in the surface volume, i.e. the binding pairs of the surface-bound-electrons, are removed from the surface volume. The surface-bound-electrons which lose the binding pairs (holes) are released from the surface of the crystal. The released electrons may easily be collected by the collecting electrodes. The removal (or elimination) of the holes from the surface volume is easily achieved in the conductive material, which is connected with the external power source.

When the irradiation of an electron beam on the conductive material has been made, the true secondary electrons are emitted from the surface of the conductors, leaving the holes in the surface volume of the conductor. The true secondary electrons may be instantly attracted by the holes in the surface volume of the conductor to form the surface-bound-electrons. When the conductor is connected to the external power source, the electrons are injected into the conductor from the power source through the connected electrode. The injected electrons which have a high mobility in the conductor, meet with the holes. The electrons then recombine with the holes in the surface volume of the conductor, eliminating the holes in the surface volume of the conductor. The surface-bound-electrons which are subsequently formed in front of the conductor, lose the binding pairs of the holes, and are released from the surface of the conductor. The electrons which are released from the surface are easily collected by the collecting electrodes. If the conductor is disconnected from the power supply, the electrons are not injected into the conductor. Therefore, the holes in the surface volume remain in their generated places. Hence, the surface-bound-electrons may stay in front of the surface of the conductor and prevent the subsequently arriving electrons from reaching the conductor. The repulsion of the incident electrons from the conductors, which are disconnected from the power source, is sometimes perceived as the negative charging of the conductor. The incident electrons are also repulsed if the negative potential is applied to the conductor. The metal mesh is a good conductor, so that the passage of the flood electrons through the metal mesh can be controlled by the on-off switching of the power supply to the metal mesh, without the insulating crystals coated on the metal mesh. A simple switching of the metal mesh gives rise to the presence and absence of luminescence from the entire phosphor screen, and does not allow the storage of specific information on the phosphor screen. For the proper operation of a storage tube, the metal mesh in the tube must be coated with the proper insulating crystals.

The insulating crystals coated on the metal mesh consist of tiny crystals. Each of them has no electrodes on the surface to make an ohmic contact with the metal mesh. This means that each crystal on the metal mesh is electrically isolated and is also electrically disconnected (i.e. floating) from the metal mesh. Therefore, there is no way to inject the electrons into the crystals from the metal mesh, or into the metal mesh from the crystals. The holes in the surface volume of the insulating crystals coated on the metal mesh in a storage tube cannot be eliminated by means of the injection of the carriers from the metal mesh.

It is found that if the insulating crystals contain the recombination centers of electron-hole pairs, then the holes in the surface volume of the insulating crystals are partially and/or totally eliminated from the surface volume when the electron-hole pairs are densely generated in the crystals. The conductance of the insulating crystals is proportional to the amount of the carriers (i.e. electrons and holes) generated in the crystals, even though the individual carrier has a low mobility in that crystal; the conductance is increased with an increase in the density of the carriers in the crystal. The high density of the carriers are locally and instantaneously generated in the crystals coated on the metal mesh under the irradiation of the writing electron beam. While the crystals are conductive, the holes in the surface volume of the crystals may migrate into the bulk of the conductive crystals, and ultimately the holes are recombined with the electrons at the recombination centers of electron-hole pairs; i.e. the elimination of the carriers in the crystals. The density of the carriers generated in the crystal is decreased with respect to time after the termination of the irradiation of the writing electron beam and the crystals again have a low conductance. A large effect of the recombination centers of the electron-hole pairs, and of the temporarily high conductance on the surface-bound-electrons seems to instantaneously reduce the binding force of the surface-bound-electrons. If the electric field produced by the collecting electrodes is applied over the insulating crystals on the metal mesh, the surface-bound-electrons, whose binding force has instantaneously been weakened under the irradiation of the writing electron beam, may be removed from the surface of the crystals. Therefore, the insulating crystals coated on the metal mesh in a storage tube must contain the recombination centers of electron-hole pairs and have a high conductance under the irradiation of the writing electron beam.

There are two kinds of the recombination centers formed in the insulating crystals; radiative recombination centers (i.e. luminescence centers) and non-radiative recombination centers. It is found that the recombination centers of electron-hole pairs form at the impurities (or crystal defects) which can change valencies, and the recombination process of electron-hole pairs at the recombination centers is triggered with the first trapped carriers, either electrons or holes, depending on the recombination centers. The recombination centers triggered with the capture of electrons or holes effectively remove the holes in the surface volume of the insulating crystals. It can, however, be said that the recombination centers triggered with the capture of holes is preferable in order to remove the surface-bound-electrons on the surface of the insulating crystals.

The recombination centers triggered with the capture of holes are formed in insulating crystals with deliberately added impurities which can also be of an advanced valence such as the elements of Group I-b in the periodic table (e.g. Cu, Ag, Au), elements of the iron family (e.g. Fe, Ni, Co), manganese (Mn), cerium (Ce), praseodymium (Pr), and terbium (Tb), and with the inevitable crystal defects like the vacancies of anions. The recombination centers form in the oxide compounds, and more preferably form in the compounds containing sulfur (S), selenium (Se), tellurium (Te), and halogens (e.g. F, Cl, Br, I).

In the present invention, the insulating crystals are preferably comprised of a Group II-VI compound composed of at least one Group II element from the periodic table as cation and at least one Group VI element from the periodic table as anion, wherein the Group II-VI compound contains at least one element from Group I of the periodic table as an acceptor and at least one element from Group III or VII of the periodic table as a donor; or a Group III-V compound composed of at least one Group III element from the periodic table as cation and at least one Group V element from the periodic table as anion, wherein the Group III-V compound contains at least one element from Group VI of the periodic table as donor and at least one element from Group II of the periodic table as acceptor.

The recombination centers triggered with the capture of electrons are formed with the deliberately added impurities which can also be of a reduced valence and with the inevitable crystal defects like the vacancies of cations. The electron-triggered recombination centers may form in many compounds and even in the simple oxides like magnesium oxide, zinc oxide, and yttrium oxide.

If the insulating crystals on the metal mesh contain the recombination centers of electron-hole pairs and if the surface of the crystals is not contaminated with foreign insulators, which have no recombination centers of electron-hole pairs, the surface-bound-electrons, which are unavoidably formed in front of the insulating crystals under the irradiation of an electron beam are removed from the surface of the crystals and are collected by the collecting electrodes. If the surface of the crystals is partially or totally covered with foreign insulators, the surface-bound-electrons formed in front of the foreign insulators are never removed from the foreign insulators and electrically shield the crystals. The electrical properties of the insulating crystals on the metal mesh are concealed with the shield by the surface-bound-electrons. For this reason, the contamination of the surface of the crystals coated on the metal mesh should be avoided. If the insulating crystals, which have a clean surface and contain the recombination centers of electron-hole pairs, are coated on the metal mesh, the surface-bound-electrons can be removed from the surface of the crystals. The removal of the surface-bound-electrons from the surface of the insulating crystals will reveal the inherent and peculiar properties of the insulating crystals which are utilized in the essential mechanisms of a storage tube. The insulating crystals coated on the metal mesh in a storage tube exhibit a persistent polarization when the electric field has been applied and the persistent polarization is depolarized by the irradiation of the writing electron beam. Hence, the insulating crystals coated on the metal mesh in a storage tube have the surface-bound-electrons on the crystal surface; the surface-bound-electrons conceal the persistent polarization and depolarization of the insulating crystals.

Insulators are always polarized when an electric field is applied across the crystal, and are depolarized as the electric field is removed from the crystal. The insulating crystals used in a storage tube have a difference with respect to regular insulators; they hold the polarization, after the removal of the electric field from the crystals, i.e. exhibit a persistent polarization. This remaining polarization is called the persistent polarization or the persistent internal polarization. The polarity of the persistent polarization corresponds to the polarity of the applied field across the crystal. The mechanisms involved in the persistent polarization is not clearly understood. An explanation of the persistent polarization is as follows: The insulating crystals usually contain trapped electrons and holes. When the electric field is applied to the crystals, the electrons and holes are released from the traps, and migrate in the crystals according to the electric field. The electrons are trapped at the deep electron traps distributing on the one side of the crystal, and the holes are trapped in the deep hole traps on other side of the crystal. The separately trapped carriers may give rise to the persistent polarization. The persistent polarization is depolarized when the writing electron beam is irradiated on the persistently polarized crystals, as the result of the increased conductivity due to the huge carriers generated in the crystals. The persistent polarization, however, is not depolarized under the irradiation of the flood electrons.

If the surface of the insulating crystals is clean and if the crystals show persistent polarization, then the irradiation side of the crystals coated on the metal mesh may persistently have negative charges when a negative potential is applied to the metal mesh. The negative charges on the irradiation side of the crystals produce the negative field over the metal mesh which prevents the flood electrons from reaching the crystals. The electron beam having an energy which is large enough to penetrate through the negative field can effect the depolarization of the persistently polarized crystals. If the persistent polarization on the metal mesh is locally depolarized by the irradiation of the writing electron beam, then the flood electrons may pass through the locally depolarized area of the metal mesh and reach the phosphor screen so as to produce luminescence. The luminescence intensity from the phosphor screen is, of course, proportional to the energy of the flood electrons.

As described above, the insulating crystals coated on the mesh metal in a storage tube must have the following conditions: (i) a clean surface; (ii) contain the recombination centers of electron hole pairs; (iii) have a persistent polarization when an electric field has been applied across the crystals; (iv) have a depolarization of the persistent polarization when the writing electron beam is irradiated on the polarized crystals. If the insulating crystals coated on the metal mesh in a storage tube have all of the conditions noted above, then the storage tube may store the instantaneous information and steadily display the information on the phosphor screen by the irradiation of the steady current of the flood electrons.

Many synthesized compounds, such as oxides, sulfides, silicates, phosphates, aluminates and the like, inevitably contain lattice vacancies. Some of the compounds contain the recombination centers of electron-hole pairs caused by the lattice vacancies and exhibit the persistent polarization due to the carriers trapped in the lattice vacancies and also exhibit the persistent polarization being depolarized by the irradiation of the writing electron beam. These compounds, therefore, can be used as the insulating crystals coated on the metal mesh in a storage tube. However, the generation of the vacancies in the compounds is very sensitive to the synthesis conditions of the compounds, the rigid control thereof being very hard. Eventually, the number of the vacancies in the final products is always uncontrolled. This means that the properties of the insulating crystals are uncontrolled. A better way to obtain adequate insulating crystals, which may be coated on the metal mesh in a storage tube, is to have the impurities which form the recombination centers of electron-hole pairs, be deliberately added into the insulating crystals, with the expectation that the deliberately added impurities also form the traps of the holes and electrons so as to give rise to the persisent polarization. Because each compound requires different impurities to form the recombination centers and traps, the adequate impurities are empirically determined for the compounds with the combination of the impurities and compounds. Because the amount of the deliberately added impurities in the compounds is always under control, a high reproducibility is expected for the compounds containing the deliberately added impurities.

As the above compounds, for instance, zinc oxide and cadmium oxide are well known compounds which exhibit persistent internal polarization which is depolarized under the irradiation of long (or near) ultraviolet radiation which generates a large number of electron-hole pairs in the oxides. With these properties, zinc oxide and cadmium oxide are good candidates for the photosensitive plate used in photocopy machines.

In the case of photocopy machines, the photosensitive plate is operated in air which absorbs the short ultraviolet light and is transparent for the long ultraviolet radiation. Beside this, the zinc oxide and cadmium oxide in the photosensitive plate are embedded in an organic binder whose absorption edge lies in the near ultraviolet region. Therefore, the short ultraviolet radiation is absorbed by the air and the binder, and never reach the compounds embedded in the photosensitive plate. The persistent polarization of the oxides embedded in the photosensitive plate is only depolarized under the irradiation of the long ultraviolet radiation which is transparent to both the binder and the air. The binder and air give a limitation to the selection of the compounds used for the photosensitive plate.

In the case of a storage tube, the insulating crystals are coated on the metal mesh without a binder, in order to keep a clean surface of the insulating crystals, and the persistently polarized crystals are depolarized with the irradiation of the electron beam, instead of photons. Hence, the band gap of the compounds which determine the absorption edge of the photoradiation is no longer an important factor in the selection of the compounds used for storage tubes.

Magnesium oxide (MgO), having a band gap of 7.4 eV, has traditionally been used as the insulating crystals coated on the metal mesh of a storage tube. Magnesium oxide has the recombination centers of electron-hole pairs and exhibits the persistent polarization caused by the lattice vacancies when the electric field has been applied across the crystals, and is depolarized under the irradiation of the writing electron beam. The number of the lattice vacancies in magnesium oxide depends on the conditions of the preparation of magnesium oxide, especially atmosphere and temperature. Because the mechanisms involved in the persistent polarization and depolarization are not completely understood, only an empirical study has been conducted on the magnesium oxide coated on the metal mesh of a storage tube in order to optimize the preparation conditions of magnesium oxide. Without understanding the fundamental mechanisms involved, however, the preparation conditions of magnesium oxide are uncontrolled and the results are always varied. Thus, the properties of the storage tube, especially the writing speed, differ from tube to tube. The improvements in the reproducibility of the production and in the writing speed are a primary subject to obtain a high quality storage tube. The deliberately added impurities in some insulating crystals, which can be coated on the metal mesh of a storage tube, may achieve a high reproducibility of the production of storage tubes.

The writing speed in a storage tube corresponds to the speed of depolarization which is a function of the amount of carriers generated in the crystals and of the mobility of the carriers in the crystal. Under a given set of operating conditions, the amount of the carriers generated is constant, and therefore, the writing speed relates only to the mobility of the carriers.

The large persistent polarization and large mobility of the carriers are a necessity for the insulating crystals coated on the metal mesh in a storage tube. It is found that many compounds show the persistent polarization, and that they are depolarized by the irradiation of the electron beam having a high energy. Some of the compounds have a large mobility of the carriers so as to achieve a high writing speed of the storage tube. They are Group II-VI compounds, such as sulfides, selenides and oxides of zinc, cadmium and a mixture of zinc and cadium, and Group III-V compounds such as phosphides, arsenides and nitrides of gallium, indium and aluminum, both preferably containing a small amount of the transition elements, for example, the elements of Groups Ib, IIb, IIIb, IVb, Va, Vb and VIa, and the iron family. Simply oxides, halo-oxides, silicates, aluminates, and oxysulfides of yttrium, gadolinium, lanthanum, lutetium, zinc, calcium, strontium, barium, cadmium and their mixture, show a persistent polarization and have a large mobility of the carriers.

For the application of the sulfides and selenides to a storage tube, the contamination of the surface should be avoided in the tube production process. The surface of the sulfides and selenides is chemically unstable in air, especially with moisture and at elevated temperature. The surface layers of the sulfides and selenides are easily oxidized in the production process of a storage tube and the surface layer chemically converts to the compounds containing oxygen (i.e. a contaminated layer) in which the recombination centers in the bulk no longer act as the recombination centers of electron-hole pairs. Therefore, there is no way to remove the surface-bound-electrons formed in front of the contaminated layer, and the surface-bound-electrons apparently stick on the sulfides and selenides. They effectively shield the sulfides and selenides, thereby preventing the flood electrons from reaching the metal mesh. The persistent polarization and depolarization of the sulfides and selenides are thus concealed by the negative shield by the surface-bound-electrons formed in front of the contaminated layer. Eventually, no storage action will be observed. If the surface of the sulfides and selenides on the metal mesh is clean, the sulfides and selenides show a persistent polarization, when an electric field has been applied, and a rapid depolarization under the irradiation of the writing electron beam, thereby realizing a high writing speed of the storage tube.

The persistent polarization and depolarization of the insulating crystals, coated on the metal mesh in a storage tube, controls the passage through and the rejection of the flood electrons at the metal mesh. The control of the flood electrons passing through the metal mesh, by means of the persistent polarization and depolarization, can clearly be confirmed with the following measurements.

The tiny crystals of the insulating crystals in powder form, of which each crystal has a clean surface, are coated on the metal mesh with the average thickness of two layers, and then the metal mesh is mounted in the tube illustrated in FIG. 1. According to the configuration of the tube shown in FIG. 1, the current meter 6 does not show any current flow if the electrons from the cathode 2 do not pass through the metal mesh 4. If the electrons from the cathode 2 pass through the metal mesh 4, then the electrons are collected by the electrode 5, and the current meter 6 shows the current flow through the meter. Thus, one can study the passing of electrons through the metal mesh as controlled by the persistent polarization and depolarization of the insulating crystals on the metal mesh by using the current meter 6. The persistent polarization and its polarity of the insulating crystals on the metal mesh can be determined separately by measuring the surface potential of the insulating crystals after the negative and positive electric potentials have been respectively applied to the metal mesh. When a negative potential has been applied to the metal mesh, the negative surface potential is detected on the surface of the insulating crystals and the positive surface potential is detected when a positive potential has been applied to the metal mesh. The depolarization can be detected by measuring the surface potential on the insulating crystals on the metal mesh. After the confirmation has been made that the crystals on the metal mesh hold a persistent polarization, the writing electron beam is irradiated on the entire area of the persistently polarized crystals on the metal mesh. No surface potential is detected on the crystals irradiated by the writing electron beam. Thus, the persistent polarization and depolarization of the insulating crystals on the metal mesh have been determined. The measurements of the current flow through the current meter 6, by means of the persistent polarization and depolarization of the insulating crystals on the metal mesh are then made. In this study, the level of the electron flow from the cathode 2, of course, is maintained at a constant value throughout the potentials studied.

Figure 2:
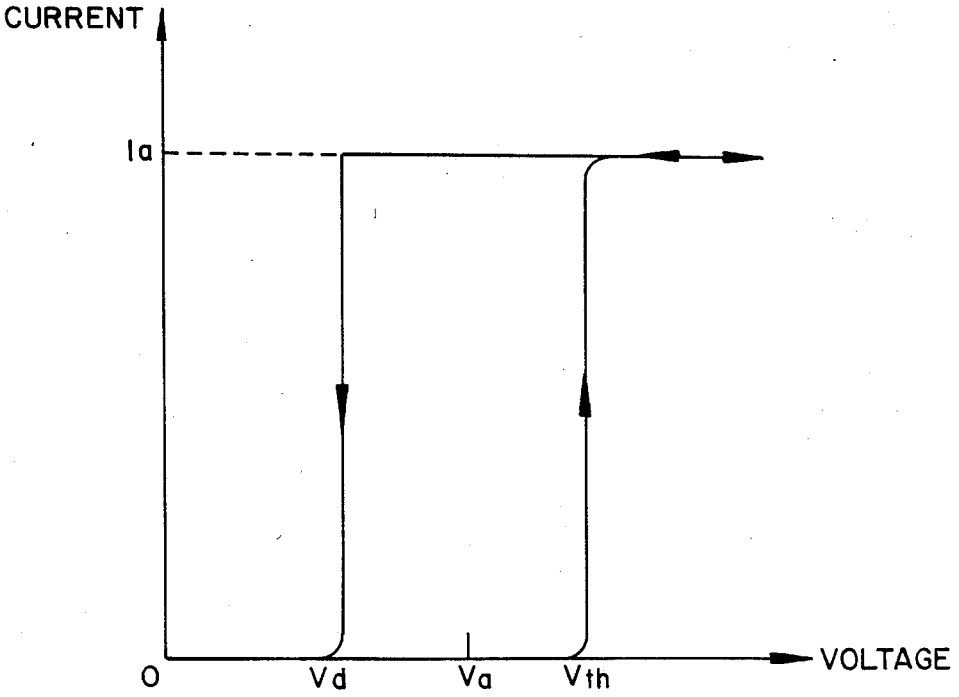
FIG. 2 is a hysteresis curve with respect to the passage of electrons through the metal mesh coated with the insulating crystals in accordance with the present invention.

When a negative potential, e.g. −250 volts, has been applied to the metal mesh, the polarity of the persistent polarization of the insulating crystals on the gun side is negative. Then, the potential of the metal mesh 4 is made equal to that of the cathode 2, i.e. there is no potential difference between the metal mesh 4 and cathode 2. When the potential of the metal mesh gradually increases from zero, the current meter 6 shows no current flow until the potential at the metal mesh reaches $V_{TH}$ shown in FIG. 2. The current meter 6 suddenly shows the current flow at $V_{TH}$, and the current immediately reaches a constant value $i_a$. The current flow is maintained at the constant value of $i_a$ for further increases in the potential at the metal mesh. After this, when the potential at the metal mesh gradually decreases from above $V_{TH}$, the current flow is maintained at the constant value of $i_a$ even with the potential below $V_{TH}$ but higher than $V_d$ as shown in FIG. 2. Below $V_d$, but higher than zero, the current meter 6 shows a zero current flow, indicating no electron flow passing through the metal mesh. Hence, a hysteresis effect is observed in the passage of electrons through the metal mesh in the storage tube. Then, when the potential of the metal mesh is again increased from zero, then the current meter 6 shows the current flow of $i_a$ when the potential is above $V_d$, instead of $V_{TH}$ and $V_{TH}$ is not observed. The application of the negative potential, for instance −250 volts, to the metal mesh is an essential necessity to observe $V_{TH}$. When the negative potential has been applied to the metal mesh, the hysteresis shown in FIG. 2 is always observed in the electron flow collected by the electrode 5. Because the hysteresis shown in FIG. 2 coincides with the persistent polarization and depolarization of the insulating crystals on the metal mesh, it can be said that the hysteresis is caused by the persistent polarization and depolarization of the insulating crystals coated on the metal mesh. If this is true, the passage of the electrons through the metal mesh is controlled by the persistent polarization and depolarization of the insulating crystals. The hysteresis is repeatedly observed by the irradiation of the electrons after the negative potential has been applied to the metal mesh.

The storage tube essentially utilizes the hysteresis shown in FIG. 2. This is explained below: When the negative potential has been applied to the metal mesh, the insulating crystals on the metal mesh have a persistent polarization with the negative polarity on the flood gun side. If a potential between $V_d$ and $V_{TH}$, for instance $V_a$ in FIG. 2, is applied to the metal mesh, the flood electrons are accelerated with the potential difference between the cathode 2 and the metal mesh 4 (i.e. $V_a$) which has an energy which is not enough to penetrate through the negative field produced by the persistent polarization. Eventually, the flood electrons are repulsed from the negative field and are collected by the collecting electrodes. This means that the flood electrons never reach the phosphor screen. When a local area of the persistently polarized crystals on the metal mesh is irradiated by the electron beam which has an energy greater than $V_{TH}$ as shown in FIG. 2, the electrons penetrate through the negative field produced by the persistent polarization and reach the insulating crystals. The persistently polarized crystals in the area which is irradiated are then depolarized. The flood electrons may pass through this local area of the metal mesh. Subsequently, the local area of the phosphor screen, corresponding to the depolarized area of the insulating crystals on the metal mesh, produces aluminescence.

As already explained above, the hysteresis is caused by the persistent polarization when the electric field has been applied, and when an electron beam which has an energy greater than $V_{TH}$ is irradiated on the polarized crystals, then the persistently polarized crystals are depolarized. For a given insulating crystal, the speed of the depolarization, corresponding to the writing speed of the storage tube, is proportional to the number of electron-hole pairs generated in the insulating crystals per unit time; the speed is increased with an increase in the number of the electron-hole pairs produced in the insulating crystals per unit time which is proportional to the energy dumped into the insulating crystals. The energy dumped by the electrons is proportional to the product of the accelerating voltage of the electrons and the beam density on the insulating crystals. In order to obtain a high resolution of the information on the phosphor screen, a writing electron beam having a small size is used, so that the beam density is not a large variable factor. In many cases, the writing electron beam is accelerated with a high voltage, e.g. 4 kV, in order to increase the writing speed.

Figure 3:
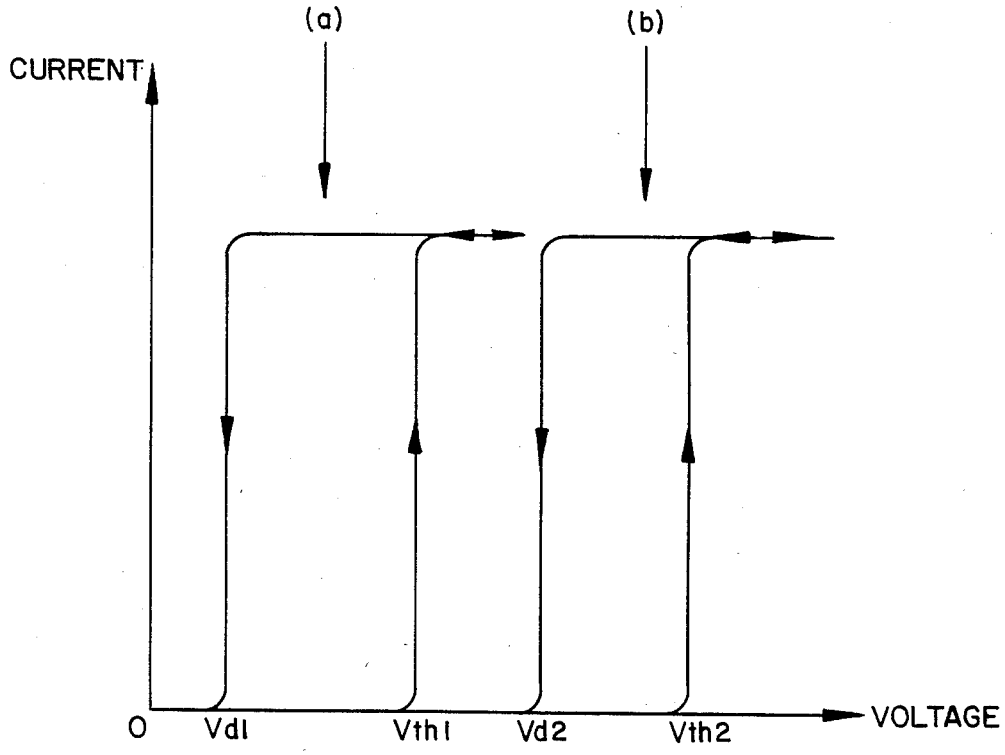
FIG. 3 is the hysteresis curves with respect to the passage of electrons through the metal mesh coated with insulating crystals having two different thicknesses; curve (a) is for a thin layer, and curve (b) is for a thick layer.

The voltage range of the hysteresis is changed with the thickness of the insulating crystals on the metal mesh. The lowest range, for example, between 150 and 300 volts depending on the insulating crystals, was obtained with a thickness of about two layers of the insulating crystals, and the voltage range is increased with an increase in the thickness of the insulating crystals. FIG. 3 shows examples of the shift of the hysteresis curve with an increase in the thickness of the insulating crystals; curves (a) and (b) respectively correspond to thin layers and thick layers of the given insulating crystals. An advantage of using the hysteresis in the high voltage range is that a brighter luminescence from the phosphor screen is expected for the flood electrons which have gained energy from the potential difference between the cathode and metal mesh. With thick layers of insulating crystals, however, the hysteresis appears in a narrow voltage range which results in an unstable operation of the storage tube. This unstable operation, in many cases, is not acceptable in practice. To obtain a brighter luminescence from the phosphor screen, the flood electrons which passed through the metal mesh may be subsequently accelerated by the potential difference between the metal mesh and phosphor screen. The potential difference between the metal mesh and phosphor screen should be smaller than the persistent polarization of the insulating crystals. If the potential applied between the metal mesh and phosphor screen exceeds the potential of the persistent polarization of the insulating crystals on the metal mesh, then the negative field produced by the persistent polarization is swept away with the positive potential applied to the phosphor screen, and the tube does not effect a storage action.

The insulating crystals coated on the metal mesh, in many cases, are powder consisting of either microcrystals, or polycrystals. However, a form of thin film, instead of a powder, of the insulating crystals may also be coated on the metal mesh in the storage tube. The storage tube having a thin film of the insulating crystals on the metal mesh exhibits the same storage action as that of the insulating crystal layers of a powder. A thin film on the metal mesh can be made by the deposition of a vapor of the insulating crystals in a high vacuum or by the deposition of a chemical vapor of the compounds. In the case of using a powder form of the insulating crystals, the thickness of the insulating crystals is preferably 1 to 50 layers of the crystals, more preferably 1.5 to 20 layers, most preferably 1.5 to 7 layers. In the case of a thin film of the insulating crystals, the thickness of the insulating crystals is preferably 100 to 20,000 Å, more preferably 1000 to 10,000 Å, most preferably 1500 to 3000 Å.

As clearly described above, insulating crystals in the form of either a powder or a thin film which are coated on the metal mesh in a storage tube must contain the recombination centers of electron-hole pairs and exhibit persistent polarization when an electric field has been applied and exhibit a depolarization which occurs when an electron beam having a high energy is irradiated on the persistently polarized crystals. A typical crystal which fills all of the requirements described above is, for example, zinc sulfide. The crystallized zinc sulfide without any added impurities can be coated on the metal mesh in the storage tube; however, the quality of the zinc sulfide is much improved if the zinc sulfide contains a deliberately added chlorine or aluminium impurity in a concentration of from 0.00001 to 0.0001 mole fraction, desirably around 0.0003 mole fraction. Further improvements in the persistent polarization and in the speed of the depolarization, and also a good reproducibility of the storage tube production are expected if the zinc sulfide contains a small amount of copper in a concentration of 0.00001 to 0.0001 mole fraction, desirably 0.0002 mole fraction, with the ratio of the concentration of chlorine or aluminum to the concentration of copper being between 1 and 3.

A part or all of the zinc in the zinc sulfide, containing copper and chlorine or aluminum, may be replaced by cadmium; i.e. zinc sulfide, zinc cadmium sulfides, and cadmium sulfide containing copper and chlorine or aluminum. A part or all of the sulfur in the above sulfides, containing copper and chlorine or aluminum, may be replaced by selenium; i.e. sulfides, sulfoselenides and selenides of zinc, zinc-cadmium and cadmium, containing copper and chlorine or aluminum. The impurities of copper in the above compounds may be replaced by silver or gold.

If the clean sulfides, selenides and sulfoselenides containing as the impurities at least one of copper, silver, gold and chlorine or aluminum are coated on the metal mesh in a storage tube, the tube may show the storage action caused by the properties of the compounds. The surface of the Group II-VI compounds is sometimes unstable in air; the surface of the sulfides, selenides, and sulfoselenides is sometimes oxidized in the tube production process, especially by heated air during tube production. If the surface of the Group II-VI compounds is oxidized during the tube production process, the oxidized surface layer will conceal the characteristics of the Group II-VI compounds; consequently, the tube does not exhibit the storage of information. In contrast with the sulfides, selenides and sulfoselenides, the surface of the oxides of Group II-VI compounds, like zinc oxide and cadmium oxide, is very stable and is not seriously damaged during the tube production process. It is, therefore, said that the oxides of Group II-VI compounds are a suitable material to coat on the metal mesh in a storage tube.

EXAMPLE 1

A powder of zinc oxide, which exhibits persistent polarization when an electric field has been applied and which has its persistent polarization depolarized under the irradiation of light, and which has a low conductivity in the dark and a markedly high conductivity under the irradiation of light, is coated on a metal mesh with an average thickness of 2 layers of crystals. The metal mesh is then installed in a storage tube. Using this tube, the hysteresis shown in FIG. 2 is observed in the voltage range between 100 and 200 volts when the measurements are made on the pass of flood electrons through the metal mesh as a function of the applied voltage to the metal mesh after −250 volts has been applied to the metal mesh. Hence, if the metal mesh has a potential of 150 volts, after −250 volts has been applied to the metal mesh, no luminescence is observed. With the hysteresis, the flood electrons which are accelerated by 150 volts could not reach the metal mesh and are collected by the collecting electrodes. When the writing electron beam has been instantaneously irradiated on the zinc oxides coated on the metal mesh, then the metal mesh allows the flood electrons to pass through the irradiated areas of the metal mesh. Therefore, a brilliant and steady luminescence is emitted from the local areas of the phosphor screen, corresponding to the areas of the metal mesh which have been irradiated by the writing electron beam. The writing speed of the information on the phosphor screen is 100,000,000 cm/sec which is significantly improved from the 40,000,000 cm/sec speed obtained with a metal mesh coated with magnesium oxide. The brilliant and steady luminescence is maintained on the phosphor screen until a negative potential of −250 volts is applied to the metal mesh.

EXAMPLE 2

A zinc sulfide, which contains 0.0002 mole fraction of copper and 0.0004 mole fraction of aluminum, is crystallized by heating in hydrogen sulfide. The crystals obtained show a persistent polarization when the electric field has been applied, and are depolarized under the irradiation of an electron beam having a high energy or when irradiated by ultraviolet radiation which is shorter than 310 nm. In the crystal, the pairs of copper and aluminum form the recombination centers of electrons and holes respectively. If the crystals are coated on the metal mesh, the storage tube shows the proper characteristics as a storage tube on the phosphor screen. A more reliable result is obtained with the metal mesh being coated with a thin film of the zinc sulfide. The thin film of the zinc sulfide is coated on the metal mesh at a thickness of 2 micrometers by the evaporation of the zinc sulfide crystals in a high vacuum, by heating the crystals. The vapor of the zinc sulfide in a high vacuum is deposited on the metal mesh heated at 100° C. The deposited film, without a break of the vacuum, is then further heated at a temperature of from 300 to 700° C. in order to crystallize the film. The crystallized film shows a persistent polarization which is rapidly depolarized under the irradiation of the electron beam having a high energy. It should be noted that the metal mesh coated with the film of the zinc sulfide should be installed in the storage tube, without a break of the vacuum because the surface of the zinc sulfide film is easily contaminated when the film is exposed to air, especially air containing moisture. Using this tube, the hysteresis shown in FIG. 2 is observed in the voltage range between 200 and 350 volts when the measurements are made on the passage of flood electrons through the metal mesh as a function of the applied voltage to the metal mesh after −400 volts has been applied to the metal mesh. Hence, if the metal mesh has a potential of 230 volts after −400 volts has been applied to the metal mesh, no luminescence is observed from the phosphor screen. With the hysteresis, the flood electrons which are accelerated by 230 volts could not reach the metal mesh and are collected by the collecting electrodes. When the writing electron beam has instantaneously irradiated the film of the sulfide on the metal mesh, the metal mesh allows the passage of flood electrons through only the irradiated areas of the metal mesh. Therefore, a brilliant and steady luminescence is emitted from the local areas of the phosphor screen, corresponding to the areas of the metal mesh irradiated by the writing electron beam. The critical writing speed of the information on the phosphor screen is 80,000,000 cm/sec which is improved from that of the traditional storage tube.

EXAMPLE 3

A yttrium silicate, which contains cerium in a concentration of 0.0001 to 0.01 mole fraction, exhibits a persistent polarization when an electric field has been applied, and is depolarized under the irradiation of an electron beam having a high energy. The ions of cerium form the recombination centers of electrons and holes in yttrium silicate. The metal mesh which has been coated with the yttrium silicate to a thickness of about 10 layers of crystals, is installed in the storage tube. Using this tube, the hysteresis shown in FIG. 2 is observed in the voltage range of between 500 and 600 volts when the measurements are made on the passage of flood electrons through the metal mesh as a function of the applied voltage to the metal mesh after −700 volts has been applied to the metal mesh. Hence, if the metal mesh has a potential of 550 volts after the −700 volts has been applied to the metal mesh, no luminescence is observed. With the hysteresis, the flood electrons which are accelerated by 550 volts could not reach the metal mesh and are collected by the collecting electrodes. When the writing electron beam has instantaneously irradiated the yttrium silicate crystals coated on the metal mesh, the metal mesh allows the passage of the flood electrons through the irradiated areas. Therefore, a brilliant and steady luminescence is emitted from the local areas of the phosphor screen, corresponding to the areas of the metal mesh irradiated by the writing electron beam. The writing speed of the information on the phosphor screen is 120,000,000 cm/sec which is greatly improved from that of the traditional storage tube. The brilliant and steady luminescence is maintained on the phosphor screen until a negative potential of −700 volts is applied to the metal mesh.

What is claimed is:

1. Insulating crystals which are coated on a metal mesh of a storage tube having a voltage means for creating an electric field therein, said crystals controlling the flow of flood electrons passing through said metal mesh and exhibiting a hysteresis effect with respect to said passage of flood electrons through said metal mesh, wherein said crystals have a clean surface, contain recombination centers of mobile electrons and holes which are generated therein by the irradiation of an electron beam thereon, and exhibit a persistent polarization when said electric field created by said voltage means has been applied across said crystals, and wherein said persistent polarization is depolarized when said persistently polarized crystals are irradiated by a writing electron beam.

2. The insulating crystals according to claim 1, wherein said insulating crystals are in a powder form.

3. The insulating crystals according to claim 1, wherein said insulating crystals are in a form of a film coated on said metal mesh of said storage tube.

4. The insulating crystals according to claim 1, wherein said recombination centers of electrons and holes in said insulating crystals are comprised of pairs of donors and acceptors.

5. The insulating crystals according to claim 4, wherein said insulating crystals are comprised of a Group II-VI compound composed of at least one Group II element from the periodic table as cation and at least one Group VI element from the periodic table as anion, and said Group II-VI compound contains at least one element from Group I of the periodic table as an acceptor and at least one element from Group III or VII of the periodic table as a donor.

6. The insulating crystals according to claim 4, wherein said insulating crystals are comprised of a Group III-V compound composed of at least one Group III element from the periodic table as cation and at least one Group V element from the periodic table as anion, and said Group III-V compound contains at least one element from Group VI of the periodic table as donor and at least one element from Group II of the periodic table as acceptor.

7. The insulating crystals according to claim 1, wherein said insulating crystals contain at least one transition element to form recombination centers of electrons and holes.

8. The insulating crystals according to claim 1, wherein said insulating crystals are comprised of oxides, oxysulfides, halo-oxides, silicates or aluminates of at least one element selected from the group consisting of yttrium, gadolinium, lanthanum and lutetium, and wherein said insulating crystals further contain at least one transition element selected from the group consisting of Ce, Eu, Sm, Dy, Tb, Pr, Yb and Nd.

* * * * *